United States Patent [19]

Rattner

[11] 4,071,140

[45] Jan. 31, 1978

[54] PACKAGE AND DISPLAY DEVICE

[76] Inventor: Richard G. Rattner, 137 Palmyra Ave., Woodmere, N.Y. 11598

[21] Appl. No.: 771,280

[22] Filed: Feb. 23, 1977

[51] Int. Cl.[2] ..... B65D 85/18

[52] U.S. Cl. ..... 206/295; 206/45.15; 206/45.19; 206/45.31; 206/494; 206/806

[58] Field of Search ..... 211/44; 248/152; 206/45.15, 45.19, 45.14, 45.31, 45.33, 278, 281, 279, 284, 286, 287, 292, 295, 299, 49, 482, 494, 806

[56] References Cited

U.S. PATENT DOCUMENTS

| | | | |
|---|---|---|---|
| 1,541,264 | 6/1925 | Holland | 206/295 |
| 1,867,556 | 7/1932 | Moll | 206/281 |
| 2,286,647 | 6/1942 | Roberts | 206/45.31 |
| 2,549,023 | 4/1951 | Shinoda | 206/45.14 |
| 2,637,482 | 5/1953 | Broderick | 206/45.31 |
| 2,915,174 | 12/1959 | Barnhart | 206/295 |
| 3,104,011 | 9/1963 | Bowman | 206/45.33 |
| 3,275,128 | 9/1966 | Neely | 206/281 |
| 3,865,234 | 2/1975 | Kester | 206/45.33 |

FOREIGN PATENT DOCUMENTS

| | | | |
|---|---|---|---|
| 52,477 | 4/1945 | France | 206/45.19 |
| 929,564 | 6/1963 | United Kingdom | 206/281 |

*Primary Examiner*—Stephen Marcus
*Assistant Examiner*—Bruce H. Bernstein
*Attorney, Agent, or Firm*—Ladas, Parry, Von Gehr, Goldsmith & Deschamps

[57] ABSTRACT

A display device for folded soft goods comprising a planar back portion, a folded up front portion, a bottom portion separating the front and back portion and forming a space for the reception of the folded goods, a roof portion adapted to be folded down from the other end of the back portion, side flaps cut out from the bottom portion and adapted in folded-up condition to act as distance spacers between said front and back portions, the arrangement being such that the spacers, from which the side flaps are cut out, form windows in the bottom portion so that the color of the contents of the package becomes visible when stacked horizontally and the side flaps act as lateral supports for the folded goods resting on the bottom portion.

The tops of the side flaps are formed by U-shaped score lines so that the upper edge of each side flap has upwardly extending fingers providing additional lateral support for the folded article.

3 Claims, 7 Drawing Figures

FIG. 1
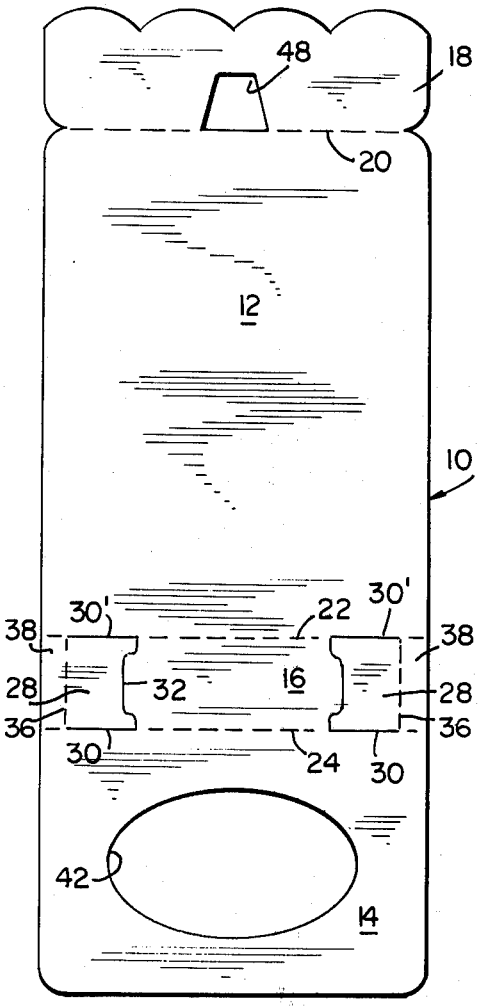
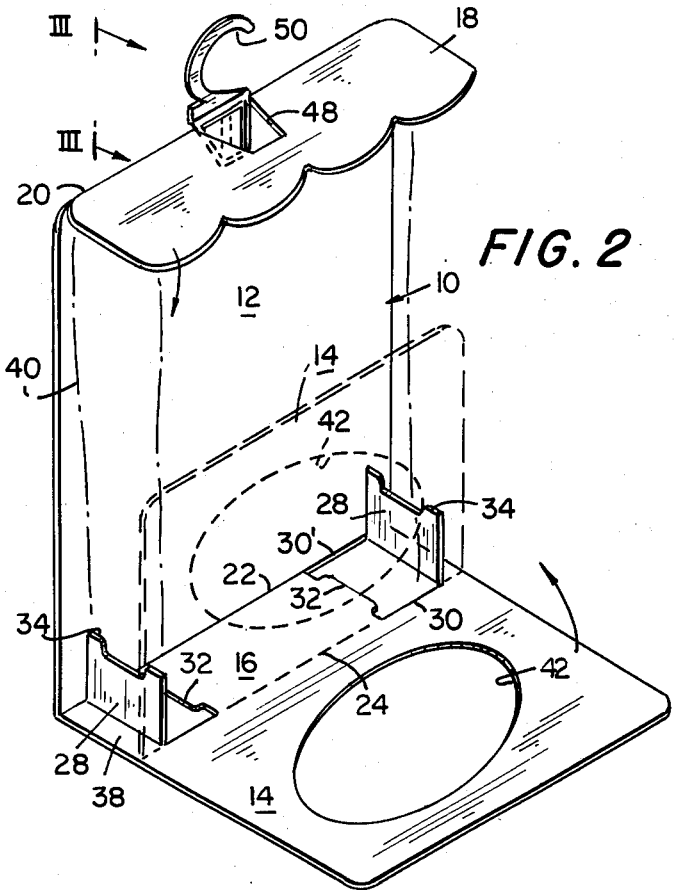
FIG. 2
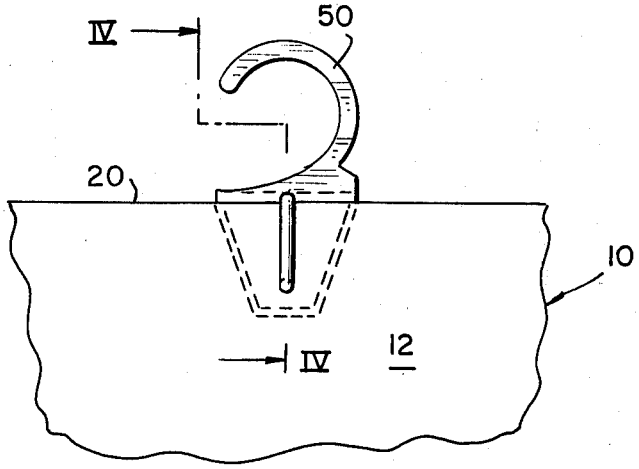
FIG. 3
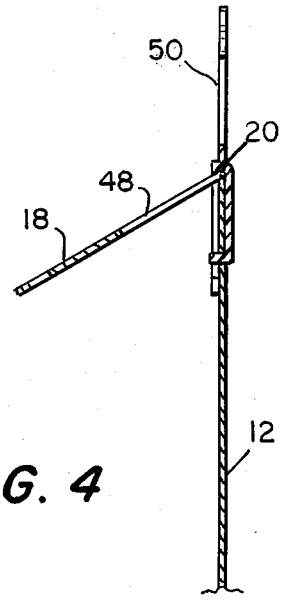
FIG. 4

PACKAGE AND DISPLAY DEVICE

BACKGROUND OF THE INVENTION

This invention relates to display package devices and is particularly concerned with a display device and package for soft goods, e.g. fabrics such as bed spreads, ruffles, shirts, towels or the like.

Display package devices are available which can be suspended by means of an eyelet or hook from a display rack. A device of this type adapted to contain flat paper goods such as greeting cards is disclosed in U.S. Pat. No. 3,104,011 (Bowman).

In the Bowman patent the top member of the stack of cards can be seen through a transparent envelope when the device is vertically suspended by means of the eyelet from a display rack. If a number of these known packages are stacked horizontally, one on top of the other as on the shelf of a store it would not be possible for a customer, or the storekeeper to see the contents of the package if the packages were resting on a shelf above eye level.

It is the object of the invention to provide a display package device which can be stacked horizontally or hung through an eyelet on a peg or hung with an attached hook from a rod and which is constructed so that the color of the contents of the package is visible to casual inspection without moving the package from the shelf or other place where the article is stored.

The invention accordingly provides a protective display package for soft goods comprising a planar back portion, a folded-up front portion, a bottom portion separating front and back portion and forming a space for the reception of the folded goods, a rood portion adapted to be folded down from the upper end of the back portion, side flaps cut out from the bottom portion and adapted in folded-up condition to act as distance spacers between said front and back portions, the arrangement being such that the spacers, from which the side flaps are cut out, form windows in the bottom portion so that the color of the contents of the package becomes visible when stacked horizontally and the side flaps act as lateral supports for the folded goods resting on the bottom portion.

Other objects of the invention will in part be obvious and in part hereinafter pointed out.

DESCRIPTION OF THE DRAWINGS

FIG. 1 is a plan view of the main supporting piece of the display package of the invention in flattened condition showing the fold lines;

FIG. 2 is a perspective view of the display package with the front portion of the main supporting piece partially folded up;

FIG. 3 shows a detail of the hook-shaped suspension means;

FIG. 4 shows a corresponding sectional side view taken along lines IV—IV in FIG. 3;

DESCRIPTION OF THE PREFERRED EMBODIMENT

Figure 5:
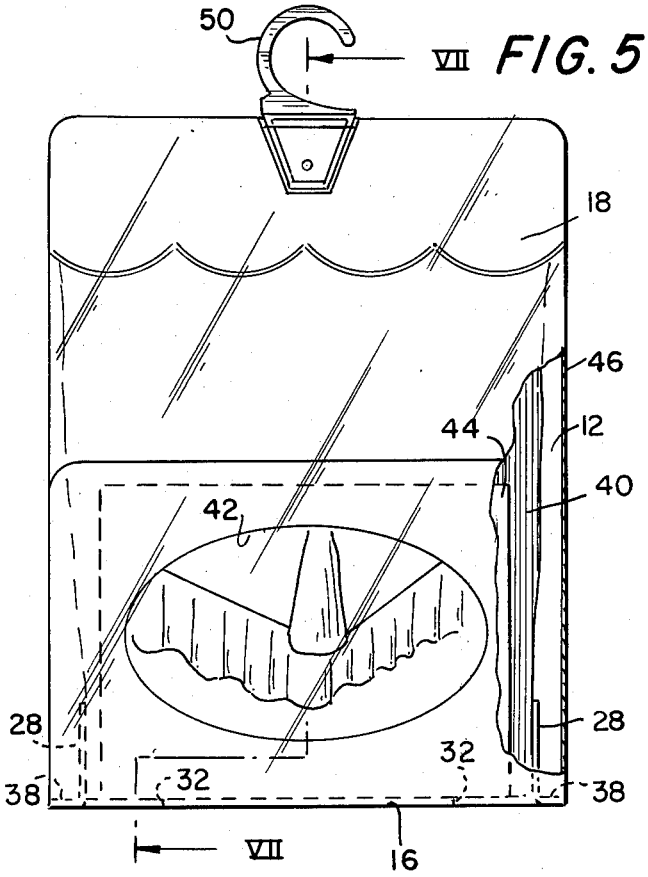
FIG. 5 is a frontal view of the folded-up display package enclosed in a transparent envelope and with a picture of the contents visible through a window.
Figure 6:
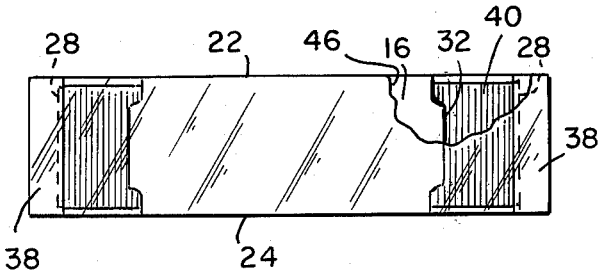
FIG. 6 is a corresponding underside view, partly broken away.

Referring now to the drawing, the display package comprises a main supporting piece 10, preferably made of cardboard of convenient stiffness. The supporting piece 10 consists of a planar back portion 12 and a front portion 14 the front and back portion being connected by an intermediate or bottom portion 16. At the upper end, the back portion 12 is formed with a roof flap 18 separated by a fold line 20 (shown dotted).

On either side of the bottom portion 16, there are provided similar folded lines 22, 24. When the front portion 14 is folded up the device will assume a generally J-shaped, see FIG. 2.

The roof flap 18 along its front edge 26 has a scalloped finish to give a pleasing appearance. The provision of these scallops is, however, merely a matter of design and does not affect the nature of the invention.

The main feature of the invention resides in the provision of cut-out side supports or flaps 28. Each side flap is formed by short score lines 30–30' overlying part of the folded lines 22, 24. At their inward extremities, the score lines 30, 30' are joined by a U-shaped transverse cut 32 which is of such a shape that when the side flaps are folded up into the position shown in FIG. 2 the upper edge of each flaps 28 has two upwardly extending fingers 34. The flaps 28 are each folded about a fold line 36 which runs paralled to side edges 12' of the back portion 12, but are inwardly spaced therefrom by a narrow land 38. The lands, in the folded-up position of the flaps form a ledge or step which can be clearly seen in FIG. 2.

Figure 7:
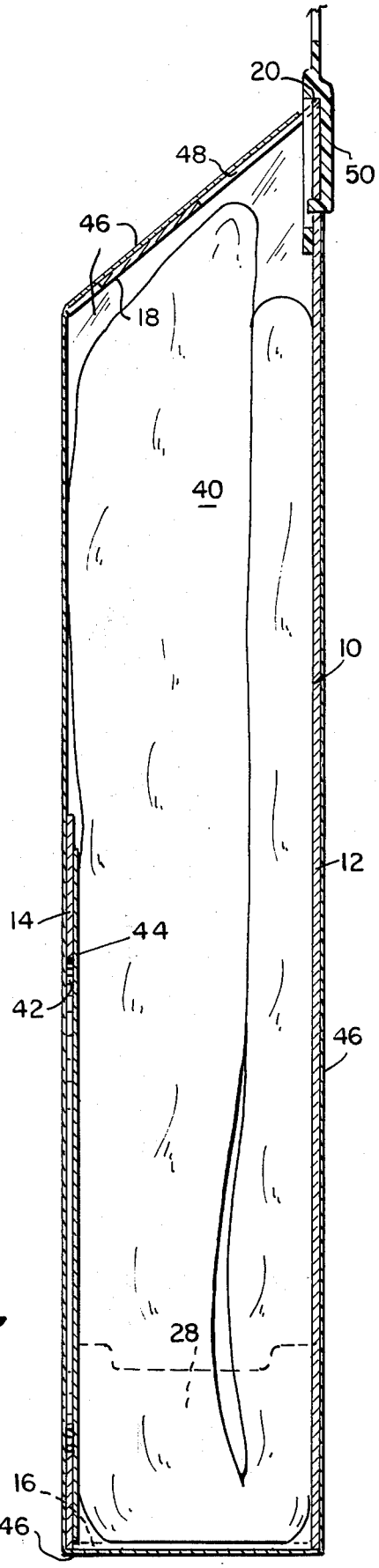
FIG. 7 is a sectional side view to an enlarged scale taken along lines VII—VII in FIG. 5.

The blanket, bed spread or other article 40 to be placed in the package is folded up as shown in FIG. 7 with the width of the folded article corresponding to the distance between the fold lines 36. The vertical dimension of the folded article 40 corresponds to the distance between bottom portion 16 and the roof flap 18.

The front portion 14 may be formed with an oval or elliptical window 42. The provision of the window permits of viewing the picture and description of the contents of the package when it is suspended vertically from the top by means to be described.

If desired a display card 44 carrying advertising matter (FIG. 7) can be inserted between the folded article 40 and the display window 42.

When the package is laid down flat, the contents can be seen through windows formed by the cut-outs in the bottom portion 16 formed by the up-folded side flaps 28.

The entire package with the exception of the suspension hook are enclosed in a transparent plastic envelope 46, or a shrink film.

At its upper end, the roof flap 18 is formed with a cut-out 48 (FIG. 2) for the reception of a clipped-on hook 50 of known construction. Instead of the hook the cut-out portion 48 could be folded up and provided with an eyelet (not shown).

What is claimed is:

1. A display package for folded soft goods comprising a planar back portion, a folded up front portion, a bottom portion separating front and back portions and forming a space for the reception of the folded goods, a roof portion folded down from the other end of the back portion, fold lines along either side of the bottom portion, short score lines overlying part of said fold lines, a pair of U-shaped transverse cuts joining said score lines, said score lines and transverse cuts forming side flaps folded up from the bottom portion and to act as distance pieces between said front and back portions and impart rigidity to the package, the arrangement being such that the spaces, from which the side flaps are cut out, form windows in the bottom portion so that the contents of the package become visible and the side flaps act as lateral supports for the folded goods resting on the bottom portion.

2. A display package as claimed in claim 1, wherein the tops of the side flaps are formed by U-shaped score lines so that the upper edge of each side flap has upwardly extending fingers providing additional lateral support for the folded article and the side flaps are folded about fold lines spaced inwardly forming narrow lands or ledges in their up-folded state.

3. A display package as claimed in claim 2, wherein the front portion is formed with a display window and a display card is adapted to be slipped between said window and the folded article and the entire package is enclosed in a transparent plastic envelope or a shrink film.

* * * * *